US005716152A

United States Patent [19]

Kudo

[11] Patent Number: 5,716,152

[45] Date of Patent: Feb. 10, 1998

[54] WRITING TOOL

[75] Inventor: Naoto Kudo, Tokyo, Japan

[73] Assignee: Zebra Co. Ltd., Tokyo, Japan

[21] Appl. No.: 798,987

[22] Filed: Feb. 11, 1997

[30] Foreign Application Priority Data

Feb. 15, 1996 [JP] Japan ..... 8-027855

[51] Int. Cl.[6] ..... B43K 7/00

[52] U.S. Cl. ..... 401/199

[58] Field of Search ..... 401/196, 198, 401/199, 202, 203

[56] References Cited

U.S. PATENT DOCUMENTS

| | | | |
|---|---|---|---|
| 3,578,870 | 5/1971 | Viti | 401/199 |
| 4,221,493 | 9/1980 | Cole et al. | 401/199 |
| 4,669,906 | 6/1987 | Narushima et al. | 401/199 X |
| 4,753,546 | 6/1988 | Witz et al. . | |
| 4,776,718 | 10/1988 | Heinzmann et al. | 401/199 X |
| 5,051,015 | 9/1991 | Moeck | 401/202 |
| 5,066,156 | 11/1991 | Petrillo et al. | 401/202 |
| 5,119,838 | 6/1992 | Nakazima | 401/199 X |
| 5,297,883 | 3/1994 | Ozu | 401/199 X |
| 5,433,545 | 7/1995 | Keil | 401/199 X |
| 5,451,114 | 9/1995 | Ishigaki . | |

FOREIGN PATENT DOCUMENTS

| | | | |
|---|---|---|---|
| 0210312 | 2/1987 | European Pat. Off. . | |
| 2934695 | 3/1981 | Germany | 401/199 |
| 2236509 | 4/1991 | United Kingdom . | |

*Primary Examiner*—William E. Stoll

*Attorney, Agent, or Firm*—Greenblum & Bernstein, P.L.C.

[57] ABSTRACT

On both cap and tubular sheath are formed sealing fit portions for sealing between a writing tip and a front-end opening of the tubular sheath and also formed override fit portions for preventing dislodgement of the cap from the tubular sheath in such a manner that their sealing fit motion and override fit motion start simultaneously at the time of mounting of the cap, whereby the loading on a finger tip in the course of mounting the cap is only once. The outer surface of the cap is integrally provided with a clip which is wider than a connecting leg portion for connection with the cap and which defines an air flow gap extending from the clip head including the connecting leg portion up to the opening portion. Further, on both sides of the connecting leg portion are formed longitudinal grooves extending continuously in parallel from the head portion toward the opening portion so that even in the event of swallowing the cap there can be ensured a wider and fully sufficient air flow area with more safety by the air flow gap formed between the outer surface of the cap and the clip and also by the two longitudinal grooves.

7 Claims, 12 Drawing Sheets

WRITING TOOL

BACKGROUND OF THE INVENTION

The present invention relates to a writing tool such as, for example, a sign pen or an aqueous ball-point pen. Particularly, the invention is concerned with a writing pen wherein a writing tip, to which ink is fed from an ink absorbing and storage member loaded into a tubular sheath, is attached to the front end of the tubular sheath through a ferrule, and a cap for sealing the writing tip is fitted on the tubular sheath front end removably, while a tail stopper is fixedly fitted in the rear end of the tubular sheath.

Heretofore, various writing tools have been known, including sign pens and aqueous ball-point pens, and various improvements have been tried, taking note of functional characteristics such as there being no fear of ink short during writing or the discharge of ink in a larger amount than necessary, namely dripping, or smooth writing, also taking note of handleability such as easy mounting and removal of a cap, and safety such as ensured flow of air to prevent suffocation even in the event of swallow, and further taking note of ornamentation characteristics based on a beautiful appearance.

However, a writing tool which satisfies all of the above functional characteristics, handleability, safety and ornamentation characteristics has not been developed yet.

The present invention has been accomplished in view of such conventional characteristics and it is the object of the invention to provide an epoch-making writing tool which meets all of such conditions as superior functional characteristics, handleability, safety and ornamentation characteristics.

SUMMARY OF THE INVENTION

According to the present invention, in order to achieve the above-mentioned subject, a writing tool wherein a writing tip supplied with ink from an ink absorbing and storage member loaded into a tubular sheath is attached to a front end of the tubular sheath through a ferrule, a cap for sealing the writing tip is attached to said front end detachably, and a tail stopper is attached to a rear end of the tubular sheath, the tool comprising: the cap having a double tube structure comprising a bottomed tubular cap body and an inner cap provided coaxially within the cap body, and the tubular sheath comprising a tubular sheath body into which is loaded the ink absorbing and storage member and a tip holding tubular portion which is contiguous to the tubular body coaxially through a connecting portion and to which the writing tip is attached, the cap body, at the time of mounting of the cap, being fitted on a cap mounting portion of the tubular sheath body and the inner cap being fitted on the tip holding tubular portion; override fit portions and sealing fit portions being provided between said cap and said tubular sheath, said override fit portion and said sealing fit portion starting the respective override fit motion and sealing fit motion simultaneously at the time of mounting of the cap; exhaust ports being formed in an opening portion of the tip holding tubular portion, several longitudinal holding ribs for holding the ferrule being formed on the inner surface of the tip holding tubular portion, and an air flow gap extending from said exhaust ports into the tubular sheath body through the longitudinal air flow grooves each formed between adjacent said longitudinal holding ribs being formed; and air ports communicating with the interior of the tubular sheath body being formed in the connecting portion between the tip holding tubular portion and the tubular sheath body, several longitudinal holding ribs for holding the front side of the ink absorbing and storage member being formed on the front-side inner surface of the tubular sheath body and an air flow gap extending from said air ports through longitudinal air flow grooves each formed between adjacent said longitudinal holding ribs up to the tail stopper side which abuts and holds the rear side of the ink absorbing and storage member, an air intake port being formed in the tail stopper and which provides communication between said air flow gap and the interior of the tail stopper.

According to this technical means, which is described in claim 1, the override fit motion and the sealing fit motion are started simultaneously at the time of mounting of the cap, whereby the cap is fitted onto the tubular sheath. More specifically, the sealing fit motion which is for sealing and the override fit motion which is for preventing dislodgement of the cap, are performed at a time in a mounted state of the cap. Thus, a load is imposed only once on the finger tip during mounting of the cap tubular sheath.

The air present inside the inner cap flows from the exhaust ports of the tip holding tubular portion into the tubular sheath body through the interior, longitudinal air flow grooves and air flow gap, so that no internal pressure is developed inside the inner cap at the time of mounting of the cap. Also at the time of removal of the cap there does not occur any pressure reducing action (attraction) in the inner cap when the inner cap is disengaged from the tip holding tubular portion because there is ensured communication with the interior of the tubular sheath body through the exhaust ports, longitudinal air flow grooves and air flow gaps.

The air present within the cap body is fed from the air ports for the change of air to the front end of the ink absorbing and storage member loaded into the tubular sheath body, then through the longitudinal air flow grooves each formed between adjacent longitudinal holding ribs and further through the air flow gaps formed between the cap body and the tubular sheath body, up to the tail stopper side, then gets into the tail stopper through the air intake port of the tail stopper and is fed to the rear end of the ink absorbing and storage member.

Besides, the ferrule which holds the writing tip is held in place in an exactly centered state with respect to the tip holding tubular portion under the linear contact thereof with the longitudinal holding ribs.

The ink absorbing and storage member is held firmly in a centered state within the tubular sheath body by means of both longitudinal holding ribs on the inner surface of the tubular sheath body and the tail stopper.

Further, said cap is integrally provided with a clip which is wider than a projecting width of a connecting leg portion and which forms an air flow gap extending from a head portion including said connecting leg portion up to an opening portion, and the cap being also provided with parallel, continuous, longitudinal grooves extending from the head portion up to the opening portion on both sides of the connecting leg portion.

According to this technical means, which is described in claim 2, in the event an infant for example should swallow the cap, the flow of air is ensured by the air flow gap formed between the cap outer surface and the clip. Besides, a wider and fully sufficient air flow area is ensured more safely by the two longitudinal grooves extending continuously in parallel from the cap head portion toward the opening portion in cooperation with the aforesaid air flow gap.

Further, the wall thickness of the inner cap at least in the fitted range thereof onto the tip holding tubular portion is smaller than that of the other portion, and a sealing fit portion is formed on this thin-walled portion.

According to this technical means, which is described in claims 3 or 4, since the inner cap fitting range relative to the tip holding tubular portion is thin, an elastic function of the inner cap is promoted and the friction of the inner cap against the tip holding tubular portion is diminished by the said elastic function; besides, the fitting force (sealing force) of the inner cap for the tip holding tubular portion is kept stable.

Further, the writing tip is for a writing-brush pen and comprises an ink leading core portion made of a soft synthetic resin material and a tubular housing portion made of a rigid synthetic resin material, the whole of the ink leading core portion except the front and rear portions thereof being integrally covered with the tubular housing portion.

Further, the tubular housing portion covers the rear side of the ink leading core portion in such a manner that a portion thereof is inserted together with the said rear side into the ink absorbing and storage member.

According to this technical means, which is set forth in claim 5, appropriate flexibility and restoring force required as a writing-brush pen are exhibited by both writing part of the ink leading core portion formed of a soft synthetic resin material and the housing portion formed of a rigid synthetic resin material and extending up to a position near the writing part. Besides, the induction of ink from the ink absorbing and storage portion can be done surely by the ink leading core portion which is in communication with the interior of the ink absorbing and storage portion.

Besides, the ink leading core portion is not exposed in an inserted state of the rear side of the ink leading core portion into the interior of the ink absorbing and storage member.

Further, the tubular sheath and the cap are formed by molding using a synthetic resin material with fine metallic grains embedded therein.

According to this technical means, which is set forth in claims 6 or 7, the fine metallic grains are brilliant in an innumerably dotted state over the surface of the tubular sheath and that of the cap, whereby there is attained a beautiful appearance.

PREFERRED EMBODIMENT OF THE INVENTION

An embodiment of the present invention will be described hereinunder with reference to the drawings.

Figure 1A:
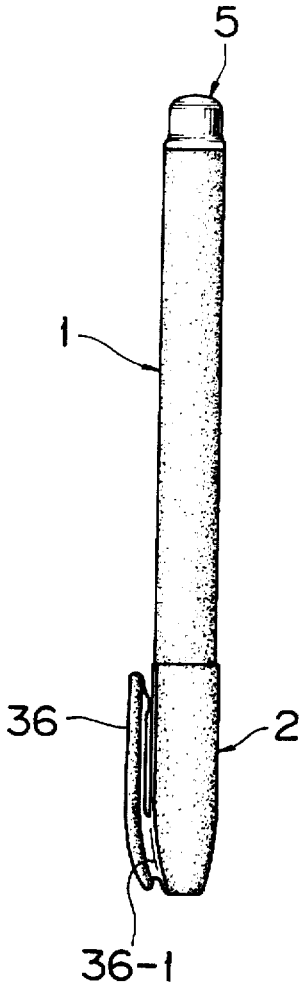
FIG. 1A shows a front view of an example of a writing tool according to the present invention.
Figure 1B:
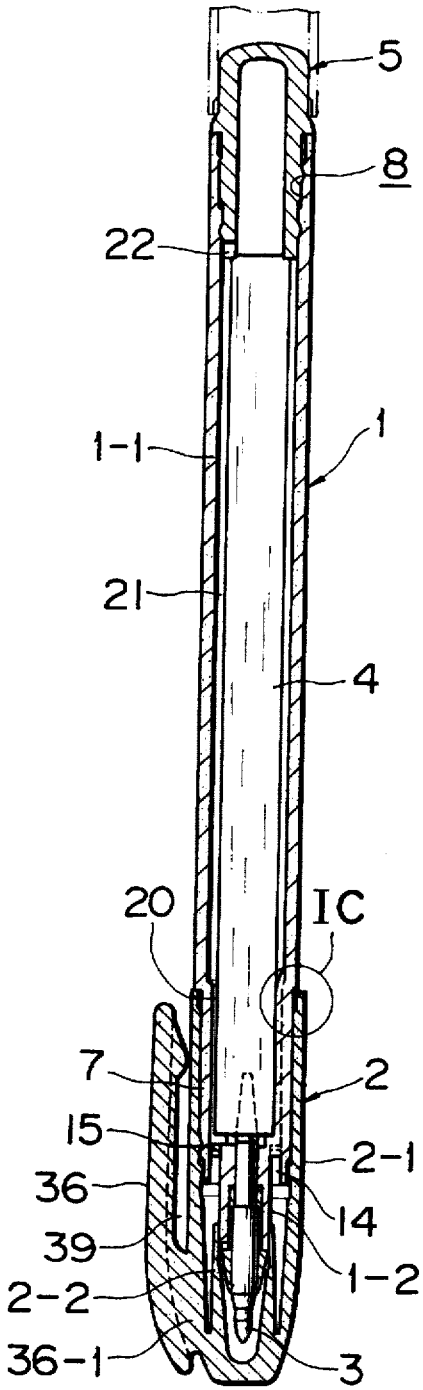
FIG. 1B is an enlarged longitudinal sectional view.
Figure 1C:
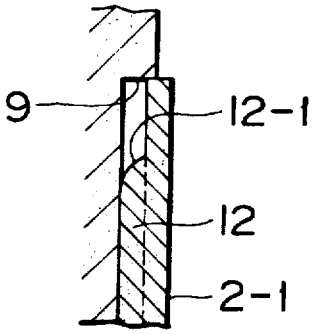
FIG. 1C is an enlarged sectional view taken at IC of FIG. 1B.

FIG. 1 is a longitudinal sectional view showing the whole of a writing tool embodying the present invention, in which the numeral 1 denotes a tubular sheath, numeral 2 denotes a cap, 3 a writing tip, 4 an ink absorbing and storage member, and 5 a tail stopper. The writing tool is constructed so that a sealing fit motion for sealing the writing tip 3 and also sealing an opening portion of a tubular sheath body 1-1 which will be described later and the override fit motion for preventing the dislodgement of the cap 2 starts simultaneously.

The tubular sheath 1 and the cap 2 are formed by molding using a suitable synthetic resin material with fine grains of a desired metal, e.g. aluminum, embedded therein uniformly and dottedly throughout the whole, then, the fine metallic grains are brilliant in an innumerably dotted state over the surface (see (i) in FIG. 1).

Figure 2:
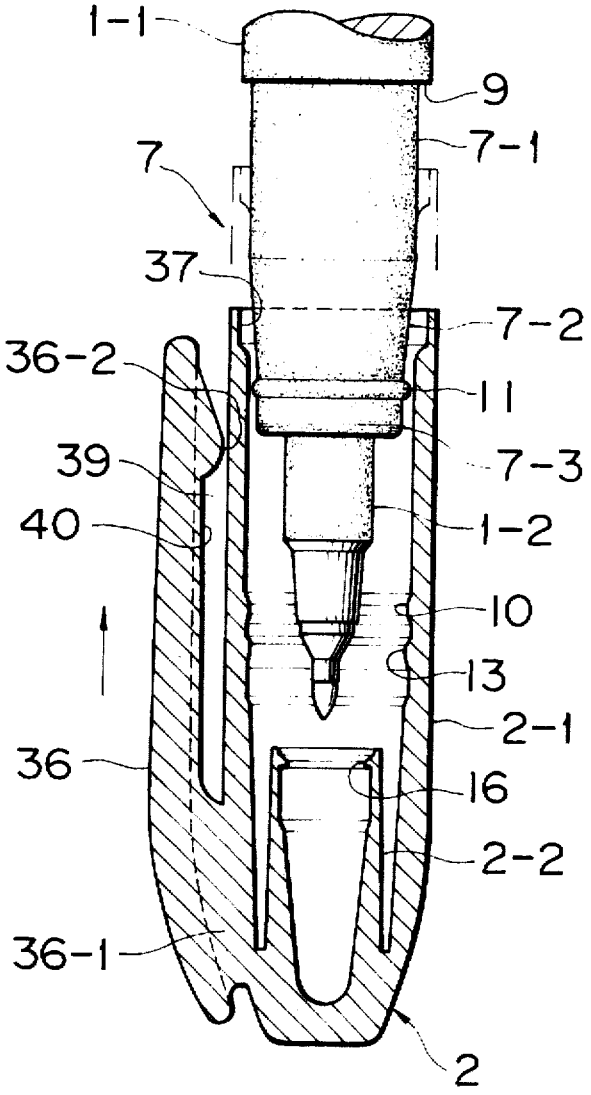
FIG. 2 is a front view of the front side of a tubular sheath, with a cap illustrated in section, showing an initial cap mounting stage.

The tubular sheath 1 comprises a tubular sheath body 1-1 into which is loaded the ink absorbing and storage member 4, and a tip holding tubular portion 1-2 for holding the writing tip 3. The tip holding tubular portion 1-2 is made contiguous to a front-end opening portion of the tubular sheath body 1-1 coaxially through a connecting portion 6, while into a rear-end opening portion of the tubular sheath body 1-1 is fitted the tail stopper 5 fixedly in a sealed state in which the communication with the exterior is cut off completely (see FIGS. 1 and 2).

The tubular sheath body 1-1 is formed in a tubular shape having suitable length and thickness which permit the ink absorbing and storage member 4 to be fitted therein loosely. On its front end-side outer surface is provided a cap mounting portion 7, while on its rear end-side inner surface is provided a stopper mounting portion 8.

The cap mounting portion 7 is formed on the front-side outer surface of the tubular sheath body 1-1 a size smaller than the other portion at an outside diameter almost equal to the inside diameter of a cap body which will be described later and in a pushed and fitted range of the cap body 2-1. The cap mounting portion 7 comprises, in order from a cap mounting base end 9 side, a straight tubular portion 7-1, a tapered tubular portion 7-2 extending from the straight tubular portion 7-1 toward a position near the opening portion and a tubular, open front end portion 7-3 extending from an inclined base end of the tapered tubular portion 7-2 toward the opening portion (see FIG. 3). On the outer surface of the inclined base end of the tapered tubular portion 7-2 contiguous to the tubular, open front end portion 7-3 is formed an override fit portion 11 for override and engagement therewith of an override fit portion 10 formed on the inner surface of the cap body 2-1 which portion 10 will be described later, at the time of mounting of the cape 2.

Figure 18:
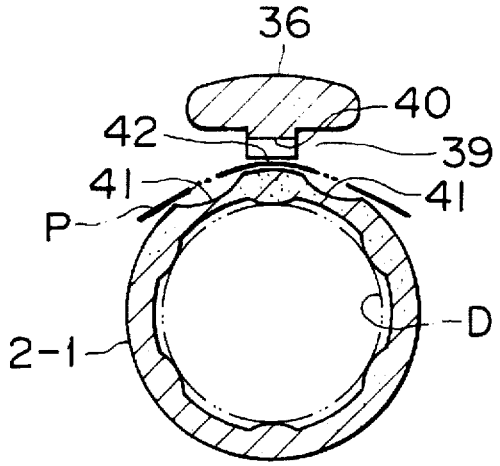
FIG. 18 is an enlarged cross sectional view taken on line XVIII—XVIII in FIG. 15.
Figure 19:
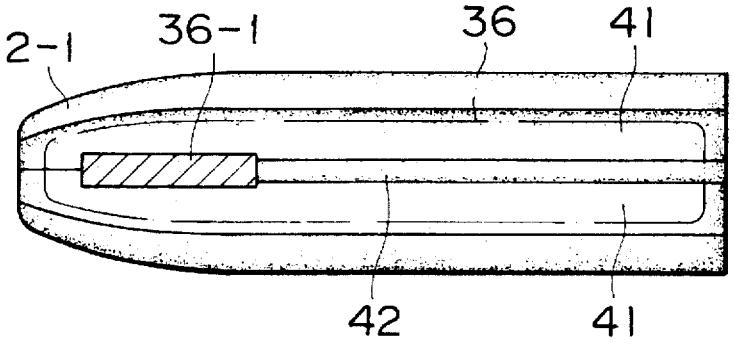
FIG. 19 is an enlarged longitudinal sectional view taken on line XIX—XIX in FIG.15.

Longitudinal ribs 12 to be described later of the cap body 2-1 come into linear contact with the straight tubular portion 7-1 at the time of mounting of the cap 2, whereby centering of the cap 2 relative to the cap mounting portion 7 is effected. The straight tubular portion 7-1 is formed in a tubular shape at an outside diameter almost equal to the inside diameter of the cap body 2-1 namely, almost equal to the diameter L of an inner profile (see FIG. 18) connecting the projecting ends of the longitudinal inner-surface ribs 12 and in a range $L_1$ from the cap mounting base end 9 to a certain position on the way to the opening portion.

The range $L_1$ of the straight tubular portion 7-1 from the cap mounting base end 9 is selected suitably. For example, the straight tubular portion 7-1 is formed in such a manner that the longitudinal ribs 12 come into linear contact with the straight tubular portion just before, or thereabouts, the override fit portion 10 formed on the inner surface of the cap body 2-1 starts to get over and engage the override fit portion 11 formed on the outer surface of the cap mounting portion 7.

The tapered tubular portion 7-2 is for permitting, at the initial mounting stage of the cap 2, the cap body 2-1 to be fitted onto the cap mounting portion 7 in a rough state with a play between the cap body 2-1 and the cap mounting portion 7. The tapered tubular portion 7-2 is inclined gently in an appropriate range $L_2$ from the straight tubular portion 7-1 toward a position close to the opening of the cap mounting portion 7. More specifically, the tapered tubular portion 7-2 is formed in a tapered shape inclined gently from its base end of connection with the straight tubular portion 7-1 toward its inclined base end side so as to become slightly smaller in diameter than the outside diameter of the straight tubular portion 7-1.

The tubular front-end release portion 7-3 is for fitting thereon of a sealing fit portion 13 to be described later of the cap body 2-1 so as to seal the opening of the cap mounting portion 7 at the time of mounting of the cap 2. It is formed in a tubular shape at an outside diameter smaller than the outside diameter of the straight tubular portion 7-1, in a released state with gap 14 ensured between it and the tip holding tubular portion 1-2 which gap will be described later, and in a range $L_3$ from the inclined base end of he tapered tubular portion 7-1 toward the opening of the cap mounting portion 7.

As the sealing fit portion 13 formed on the inner surface of the cap body 2-1 starts its sealing fit motion at the time of mounting of the cap 2, the tubular front-end release portion 7-3 performs an escaping motion toward the gap 14. More particularly, since the gap 14 is ensured between the tubular front-end release portion 7-3 and the tubular tip holding portion 1-2, a moderate elastic action is created to diminish the friction induced during the sealing fit motion of the cap body 2-1, whereby the sealing effect of sealing air ports 15 for the change of air through the gap 14 and in cooperation with the sealing fit portion 13 can be maintained constant over a long period, which air ports 15 will be described later.

The tubular front-end release portion 7-3 may be formed thin so that its elastic action can be exhibited more effectively at the time when the cap body 2-1 is fitted thereon.

The override fit portion 11 functions to retain the cap body 2-1 to the cap mounting portion 7 by virtue of a retaining force induced by engagement thereof with the override fit portion 10 formed on the inner surface of the cap body 2-1 which portion 10 gets over and comes into engagement with the override fit portion 11. The override fit portion 11 is formed at the inclined base end of the tapered tubular portion 7-2 at an annular outside diameter smaller than the inside diameter (the diameter D of an inner profile connecting circumferentially the projecting ends of the longitudinal ribs 12 formed on the inner surface of the cap body) of the cap body 2-1 so that the longitudinal ribs 12 may not be engaged with the override fit portion 11 at the time of mounting of the cap 2.

Figure 16:
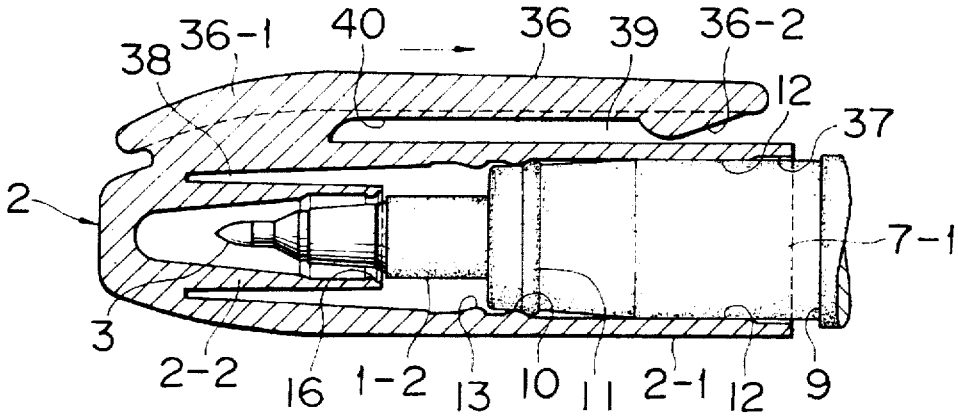
FIG. 16 is a longitudinal sectional view of the cap being fitted onto a cap mounting portion.

Thus, the cap mounting portion 7 is composed of the straight tubular portion 7-1, tapered tubular portion 7-2 and tubular front-end release portion 7-3. In the initial mounting stage of the cap 2, therefore, the cap body 2-1 can be fitted on the cap mounting portion 7 in a rough state with a play between the override fit portion 11 formed on the outer surface of the cap mounting portion 7, as well as the tapered tubular portion 7-2, and the longitudinal ribs formed on the inner surface of the cap body and without contact with the override fit portion 11 and tapered tubular portion 7-2 (the state shown in FIG. 2). Consequently, the cap 2 can be mounted in an extremely easy and simple manner and thus there is attained improvement of handleability. Besides, when the longitudinal ribs 12 formed on the inner surface of the cap body 2-1 reach the straight tubular portion 7-1 and come into linear contact with the outer surface of the straight tubular portion 7-1, there is effected centering of the cap body with respect to the cap mounting portion 7. In this centered state, the override fit portion 10 on the inner surface of the cap body 7-1 starts to override the override fit portion 11 on the outer surface of the cap mounting portion, and the sealing fit portion 13 starts its sealing fit motion for the tubular front-end release portion 7-3 (see the dash-double dot line in FIG. 2 and the state of FIG. 16). Accordingly, their fitting motions are performed smoothly and positively; at the same time, a sealing fit motion of a sealing fit portion 16 of an inner cap 2-2 of the cap 2, which will be described later, is also effected in a smooth and positive manner.

Figure 17:
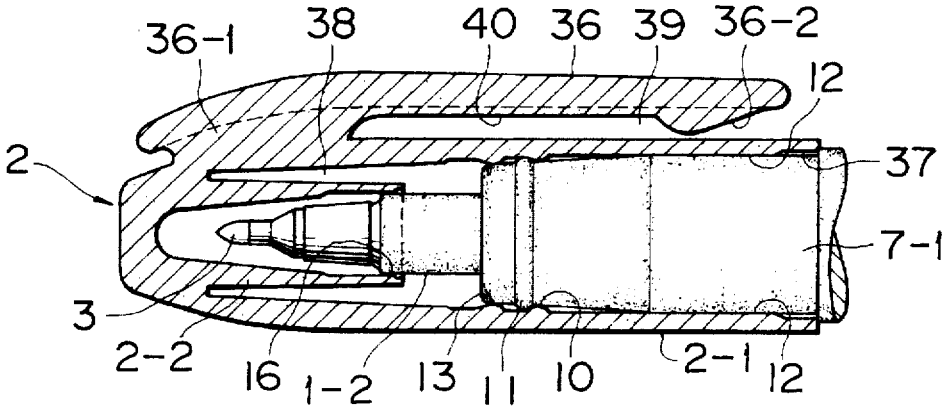
FIG. 17 is a longitudinal sectional view of the cap as fitted on the cap mounting portion.

More particularly, without causing any inconvenient engagement such as one being over engaged with the other due to decentering which would result in sluggish motion, in the course of mounting of the cap 2, the override fit motion of the override fit portion 10 on the inner surface of the cap body with respect to the override fit portion 11 on the outer surface of the cap mounting portion, as well as the sealing fit motion of the sealing fit portion 13 with respect to the tubular front-end release portion 7-3, are performed smoothly, and the cap body 2-1 is fitted on the cap mounting portion 7 while the prevention of dislodgement of the cap 2 and the sealing effect are attained positively by the override fit motion and the sealing fit motion, respectively. At the same time, the inner cap 2-2 is fitted on the tip holding tubular portion 1-2 (see the state of FIG. 17).

The tip holding tubular portion 1-2 is for holding the writing tip 3 through a ferrule 17 and onto which is fitted the sealing fit portion 16 of the inner cap 2-2 at the time of mounting of the cap 2. The tip holding tubular portion 1-2 has an outside diameter (almost equal to the inside diameter of the inner cap 22) about two sizes smaller than the inside diameter of the tubular front-end release portion 7-3 of the cap mounting portion 7, and its inner surface has a stepped bore shape comprising a large-diameter portion 18 and a small-diameter portion 19. Its rear end side in which the small-diameter portion 19 opens is integrally contiguous to the inner surface of the tubular front-end release portion 7-3 through the connecting portion 6. And from the interior of the tubular front-end release portion 7-3 the tip holding tubular portion 1-2 is projected coaxially ahead of the opening of the portion 7-3 (see (ii) in FIG. 1 and FIGS. 3, 4).

The connecting portion 6 is extended up to an appropriate depth inwardly of the opening of the tubular front-end release portion 7-3 of the cap mounting portion 7 so that the gap 14 for promoting the elastic effect of the portion 7-3 is ensured in its inward range reaching the contiguous rear end of the tip holding tubular portion 1-2. The rear end of the small-diameter portion 19 of the tip holding tubular portion 1-2 is rendered integrally contiguous to the inner surface of the cap mounting portion 7, and air ports 15 are formed for the change of air.

Figure 7:
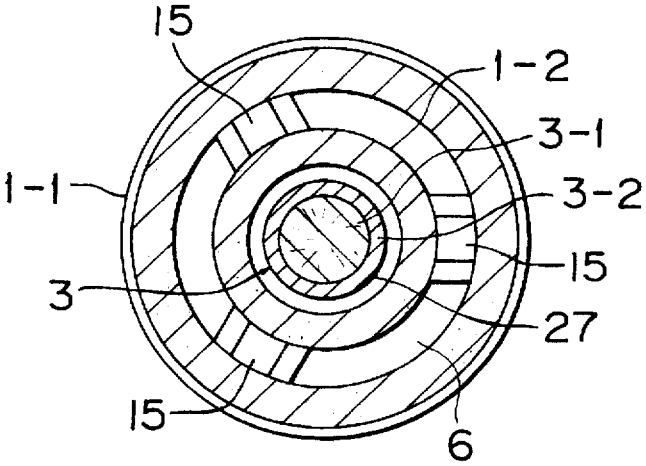
FIG. 7 is an enlarged cross sectional view taken on line VII—VII in FIG. 4.
Figure 8:
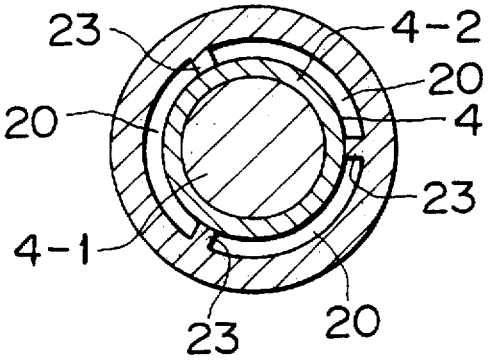
FIG. 8 is an enlarged cross sectional view taken on line VIII—VIII in FIG. 3.

The air ports 15 are for the change of air with respect to the interior of the tubular sheath body 1-1 while the writing tool is in use. At the time of mounting of the cap 2 after writing (after use), the air ports 15 function to feed the air present in the interior of the cap body 2-1 to the front end of the ink absorbing and storage member 4 loaded into the tubular sheath body 1-1 and further feed the air through longitudinal air flow grooves 20, air flow gap 21 and air intake port 22, which will be described later, to the rear end side of the ink absorbing and storage member 4 which is held abuttingly by the tail stopper 5, thereby suppressing the change in internal pressure of the front and rear ends of the member 4. The air ports 15 are formed in the connecting portion 6 in an opening shape having a suitable opening area and in several positions (three in the figure) circumferentially (see FIG. 7).

The longitudinal air flow grooves 20 are formed contiguously to the connecting portion 6 with the air ports 15 formed therein, at a projecting height capable of holding the front side of the ink absorbing and storage member 4 in a centered state with the axis of the tubular sheath body 1-1, and each between adjacent longitudinal holding ribs 23 which are provided several at appropriate intervals in the circumferential direction, in such a manner as to conduct air from the air ports 15 to the air flow gap 21 in a communicated state with the air ports (see FIGS. 3 to 8).

On the side the longitudinal holding ribs 23 contiguous to the connecting portion 6 are provided retaining portions 24 for retaining the front-end opening of the ink absorbing and storage member 4 in a spaced state from the connecting portion 6 so that the air from the air ports 15 is fed to the front end of the member 4. Further, end portions of the longitudinal holding ribs 23 which are released toward the rear end side of the tubular sheath body 1-1 are formed in a rounded shape so that the ink absorbing and storage member 4 is inserted from the rear-end opening of the tubular sheath body 1-1 into the the tubular sheath body 1-1 and between the longitudinal holding ribs 23 smoothly while being guided by rounded ends 23-1 without being caught on the ribs 23 and is held in the thus-inserted state (see FIG. 3).

The air flow gap 21 is formed between the tubular sheath body 1-1 and the ink absorbing and storage member 4 in the range from the longitudinal air flow grooves 20 up to the tail stopper 5 which abuts and holds the rear end side of the ink absorbing and storage member 4 so as to ensure communication from the air ports 15 in the tubular sheath body 1-1 up to the tail stopper 5 at the rear end in which the air intake port 22 opens.

Figure 9:
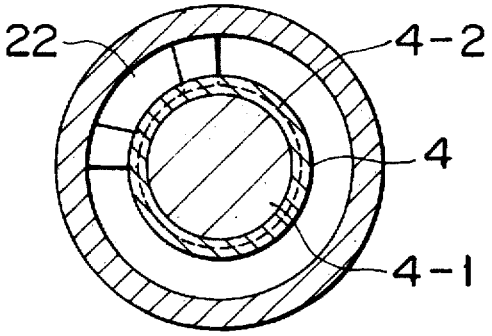
FIG. 9 is an enlarged cross sectional view taken on line IX—IX in FIG. 3.
Figure 10:
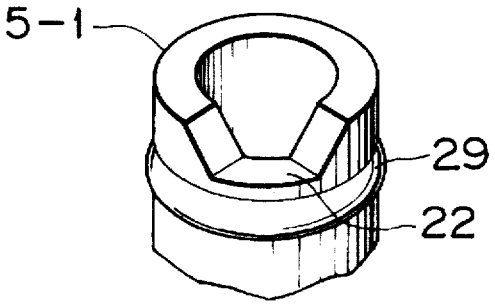
FIG. 10 is a perspective view showing a tubular mounting portion of a tail stopper provided with an air intake port.

The air intake port 22 is for conducting the air which has passed through the air flow gap 21 into the tail stopper 5 in which the rear-end opening of the ink absorbing and storage member 4 faces. It is formed by recessing an opening portion of a tubular mounting portion 5-1 of the tail stopper 5 which portion 5-1 will be described later, so as to have appropriate opening width and depth (see FIG. 3, FIGS. 9 and 10).

In this way, in the interior of the tubular sheath body 1-1 is formed an air flow structure which provides communication from the air ports 15 to the front end of the ink absorbing and storage member 4 and to the rear-end opening. At the time of mounting of the cap 2, therefore, the air present within the cap body 2-1 is fed from the air ports 15 for the change of air to the front end of the ink absorbing and storage member 4 held by the retaining portions 24 in the tubular sheath body 1-1, then passes through the longitudinal air flow grooves 20 each formed between adjacent longitudinal holding ribs 23 and further through the air flow gap 21 formed between the tubular sheath body 1-1 and the ink absorbing and storage member 4, and is fed to the tail stopper 5 side, then gets into the interior of the tail stopper through the air intake port 22 and is fed to the rear end of the ink absorbing and storage member 4 (see the arrow in FIG. 2). According to this air flow structure it is possible to prevent the shortage of ink and dripping phenomenon which occur due to the feed of air to only one of the front and rear ends of the ink absorbing and storage member 4 and due to consequent rise in internal pressure on only the one side.

Moreover, the ink absorbing and storage member 4 can be held within the tubular sheath body 1-1 by both longitudinal holding ribs 23 formed on the inner surface of the tubular sheath body 1-1 and tail stopper 5 in a centered state with respect to the axis of the tubular sheath body 1-1 by the longitudinal holding ribs 23.

Further, since the air ports 15 are opened in the connecting portion 6 which is located at an appropriate depth inwardly of the opening of the cap mounting portion 7, the presence of the air ports 15 is difficult to seen from the exterior. Thus, in comparison with the type wherein air ports 15 are opened in the surface, it is possible to prevent deterioration of the appearance, so there is no fear of deterioration in ornamental characteristics, etc. as commodity and it is possible to improve such ornamental characteristics, etc.

The numeral 25 in the drawings denotes an exhaust port (see FIGS. 4 and 5) formed in an opening shape having suitable width and depth and in several positions (three in the figures) circumferentially in the opening portion of the tip holding tubular portion 1-2. The exhaust ports 25 are brought into communication with the interior of the tubular sheath body 1-1 through longitudinal air flow grooves 26 and air flow gap 27 formed inside the top holding tubular portion 1-2 so that at the time of mounting of the cap 2 the air present inside the inner cap 2-2 is discharged from the air flow gap 27 into the tubular sheath body 1-1 through the longitudinal air flow grooves 26. At the time of removal of the cap 2, in order to prevent the occurrence of pressure reduction (attraction) inside the inner cap 2-2, there is attained communication with the interior of the tubular sheath body 1-1 by both longitudinal air flow grooves 26 and air flow gap 27 (see FIG. 4).

Figure 4:
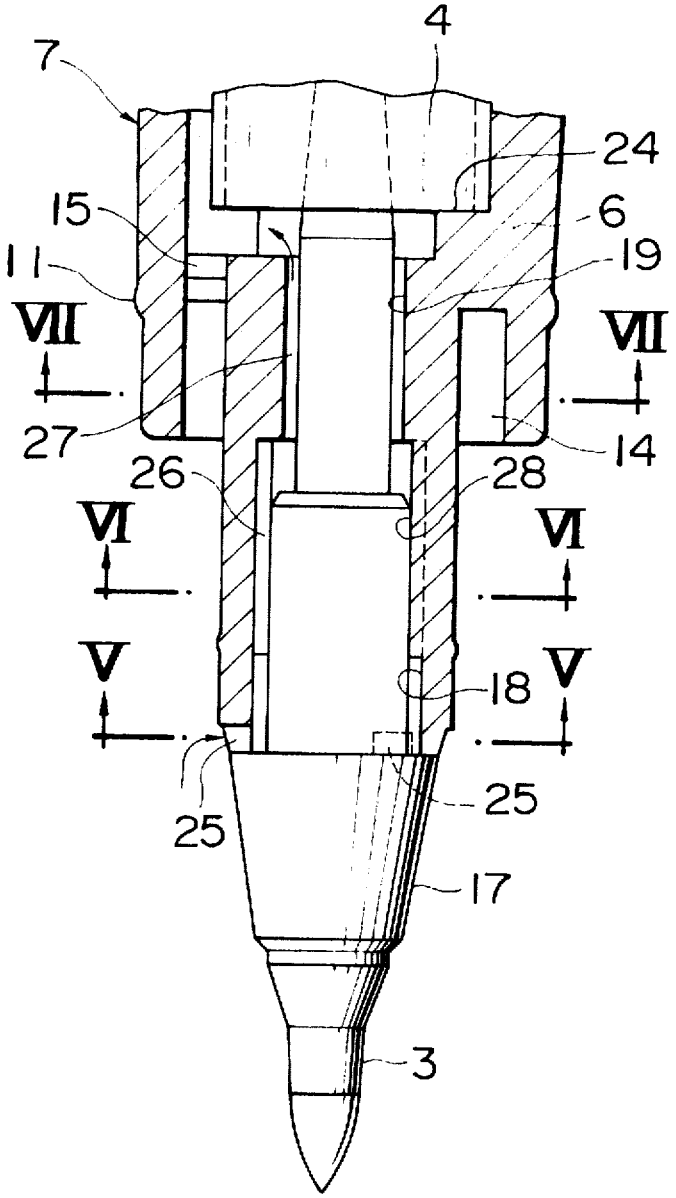
FIG. 4 is an enlarged sectional view of principal portions.
Figure 5:
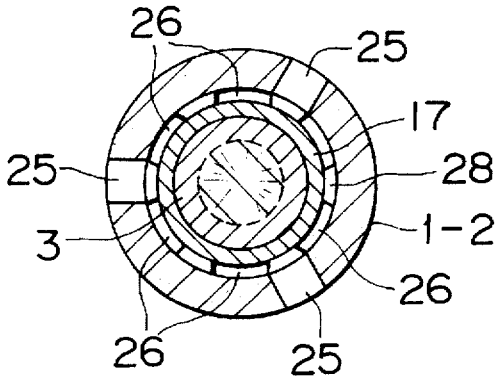
FIG. 5 is an enlarged cross sectional view taken on line V—V in FIG. 4.
Figure 6:
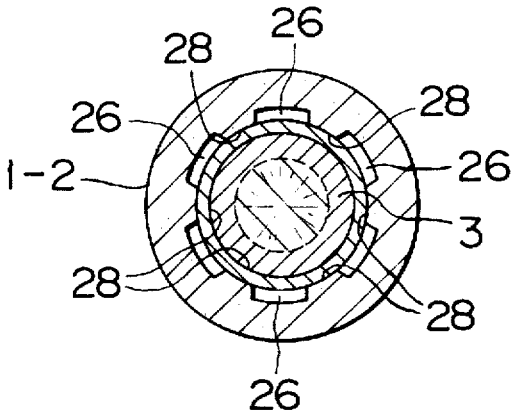
FIG. 6 is an enlarged cross sectional view taken on line VI—VI in FIG. 4.

In the inner surface of the large-diameter portion 18 over the range from a certain inward position relative to the opening of the tip holding tubular portion 1-2 up to the stepped portion contiguous to the small-diameter portion 19, the longitudinal air flow grooves 26 are formed between several longitudinal holding ribs 28 which are formed at a projecting height permitting the ferrule 17 to be press-fitted and held therein and at appropriate intervals in the circumferential direction, the grooves 26 being provided so as to provide communication between the exhaust ports 25 and the small-diameter portion 19, (see FIGS. 4 to 6).

The air flow gap 27 is for communication from the exhaust ports 25 in the tip holding tubular portion 1-2 to the interior of the tubular sheath body 1-1 through the longitudinal air flow grooves 26 each formed between adjacent longitudinal holding ribs 28. It is formed between a rear portion 3-11 of a later-described ink leading core portion 3-1 of the writing tip 3 extending from the longitudinal air flow grooves 26 to the interior of the tubular sheath body 1-1 and the small-diameter portion 19, the rear portion 3-11 being loosely inserted through the space defined by the small-diameter portion 19, whereby the communication of the exhaust ports 25 with the interior of the tubular sheath body 1-1 is ensured through the longitudinal air flow grooves 26.

Since the exhaust ports 25 are formed in the opening portion of the tip holding tubular portion 1-2 which is surrounded in a sealed state by the inner cap 2-2 and the air flow structure extending from the exhaust ports 25 to the interior of the tubular sheath body 1-1 is provided in the interior of the tip holding tubular portion 1-2, the air present inside the inner cap 2-2, at the time of mounting of the cap 2, is not pressurized but flows through the exhaust ports 25, then through the longitudinal air flow grooves 26 in the tip holding tubular portion 1-2 and further through the air flow gap 27 for communication with the interior of the tubular sheath body 1-1, and is discharged into the interior of the tubular sheath body 1-1 (see the arrows in FIG. 4). Thus, no internal pressure is developed inside the inner cap 2-2 at the time of mounting of the cap 2. That is, it is possible to prevent the occurrence of a reverse flow phenomenon such that, while the inner cap 2-2 is pushed in up to its mounting limit for the tip holding tubular portion 1-2, the ink in the writing tip 3 is forced back to the ink absorbing and storage member 4 side in the tubular sheath body 1-1, which is caused by compression of the air present inside the inner cap 2-2 to create an internal pressure inside the inner cap, and induces ink shortage when the writing tool is used.

Also at the time of removal of the cap 2 there does not occur a pressure reducing action (attracting action) because the flow of air is ensured between the interior of the inner cap 2-2 and that of the tubular sheath body 1-1. More particularly, when the inner cap 2-2 comes off the tip holding tubular portion 1-2, it is possible to prevent ink from being drawn into the writing tip 3 in a larger amount than necessary and ejection from the writing tip 3 at the time of removal of the cap or dripping from the writing tip 3 during use of the writing tool, which are caused by the reduction of pressure in the inner cap 2-2. Thus, the stability of functional characteristics which is required for the writing tool can be expected.

Further, since the tip holding tubular portion 1-2 holds the ferrule 17 which holds the writing tip 3 therethrough, not in a face contact but in a linear contact through the longitudinal holding ribs 28, the ferrule 17 can be press-fitted and held in the tip holding tubular portion 1-2 in an accurately centered state with respect to the axis of the tip holding tubular portion 1-2. Besides, the centering operation can be done more easily than in the face contact, so the work for mounting the ferrule 17 to the tip holding tubular portion 1-2 is simplified to a greater extent and hence it is possible to expect improvement of the working efficiency in the assembling work.

The stopper mounting portion 8 at the rear end of the tubular sheath body 1-1 is formed in a divergent shape such that its inner surface shape (inside diameter) expands gradually (by degrees) toward the rear-end opening of the tubular sheath body 1-1 in a length range L4 of a later-described tubular mounting portion 5-1 of the tail stopper 5. In two front and rear positions, more specifically in the base end position of that expansion and on the expanded opening side, there are formed front and rear annular protuberances 31, 32 in a diameter relation of $L_5<L_6$ with which later-described front and rear annular protuberances 29, 30 of the tail stopper 5 come into engagement. Between the front and rear annular protuberances 31, 32 is formed a centering fit portion 34 for engagement with a centering fit portion 33 of the tail stopper 5 which portion 33 will be described later.

Figure 11:
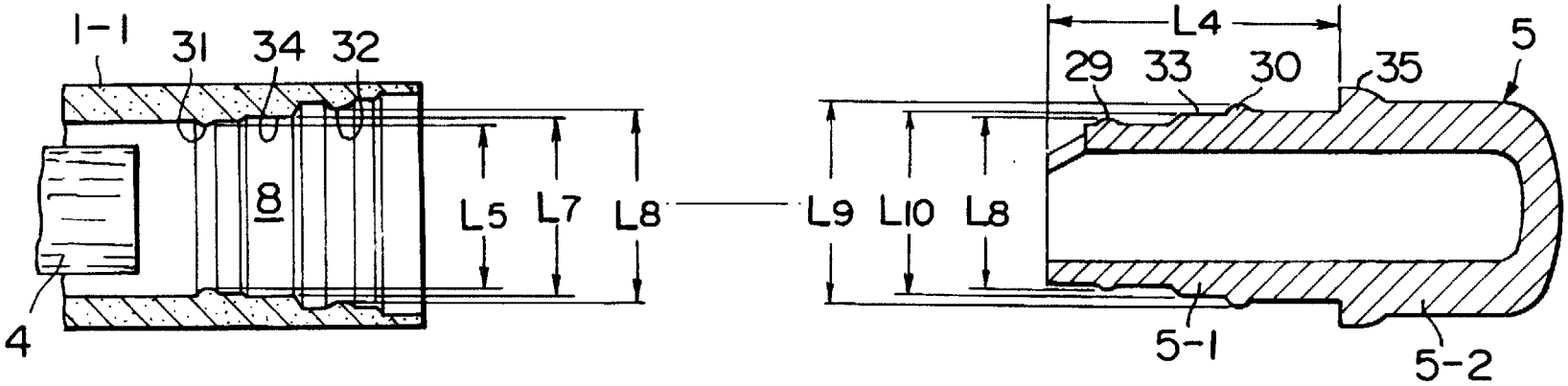
FIG. 11 is a longitudinal sectional view of principal portions with a tubular sheath body and the tail stopper separated from each other.

At the time of mounting of the tail stopper 5, the front and rear annular protuberances 31, 32 function to hold the tail stopper 5 in a sealed state for the stopper mounting portion 8 by engagement thereof with the front and rear annular protuberances 29, 30 of the tail stopper 5. The front-side annular protuberance 31 is provided on the internal base end side of the stopper mounting portion 8, while the rear-side annular protuberance 32 is provided on the expanded opening side at a diameter $L_6$ larger than the diameter $L_5$ of the front-side annular protuberance 31 (see FIG. 11).

Figure 12:
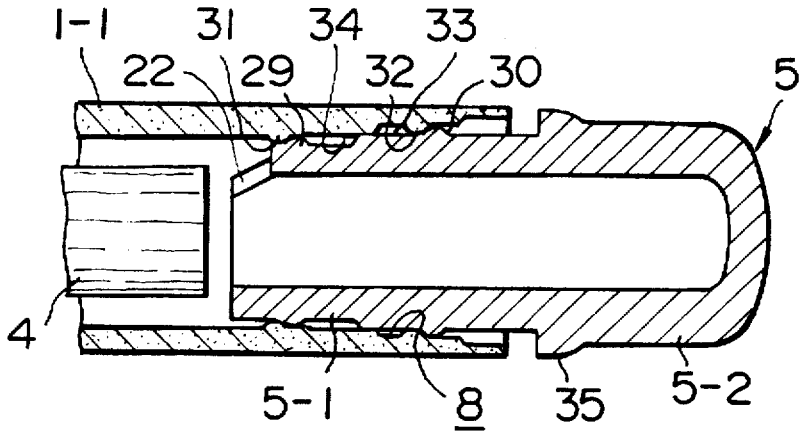
FIG. 12 is a longitudinal sectional view of the tubular sheath body and the tail stopper being mounted to a stopper mounting portion of the tubular sheath body.

The centering fit portion 34 is formed axially flatwise in the inner surface of the stopper mounting portion 8 which expands toward the opening portion, at an inside diameter $L_7$ which is larger than the diameter $L_5$ of the front-side annular protuberance 31 and smaller than the diameter $L_6$ of the rear-side annular protuberance 32. When the tail stopper 5 is to be mounted, the the centering fit portion 33 of the tubular mounting portion 5-1, which fit portion 33 is also flat, comes into centering engagement with the centering fit portion 34 (see FIGS. 12 and 13).

Figure 3:
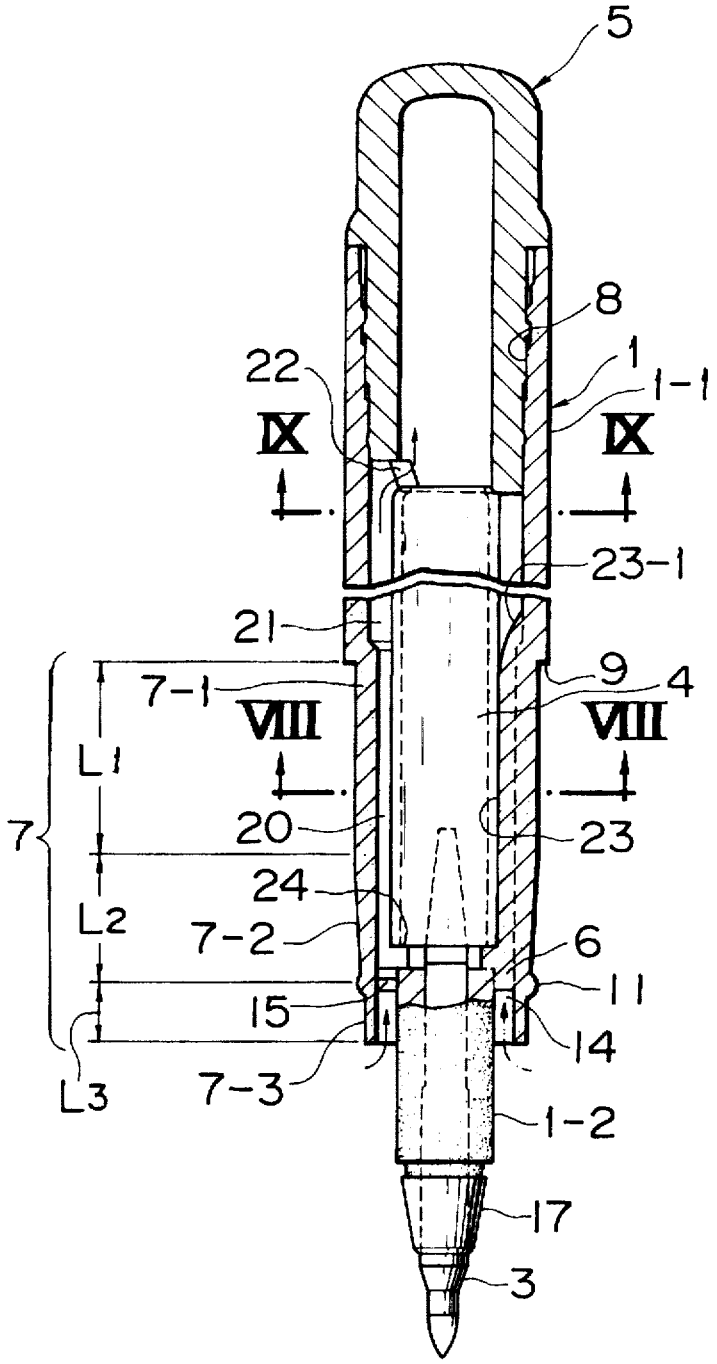
FIG. 3 is a longitudinal sectional view with the cap removed and with the length omitted.
Figure 13:
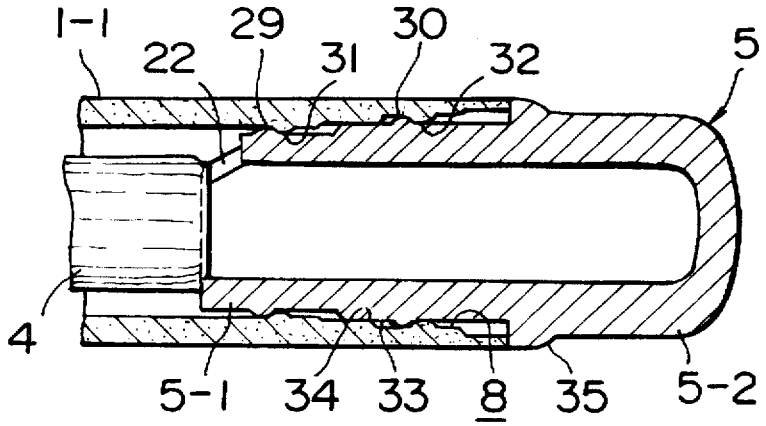
FIG. 13 is a longitudinal sectional view of the tail stopper as mounted to the stopper mounting portion of the tubular sheath body.

The tail stopper 5 functions to not only close the rear-end opening of the tubular sheath body 1-1 hermetically but also abut and retain the outer peripheral edge of a rear-end opening of a tubular housing 4-2 of the ink absorbing and storage member 4, the ink absorbing and storage member 4 comprising the tubular housing 4-2 formed of a suitable synthetic resin material and inside cotton 4-1 covered with the tubular housing 4-2 (see FIGS. 3 and 13). Using a desired synthetic resin material, the tail stopper 5 is formed in the shape of a bottomed tube having a thickness (outside diameter) almost equal to that of the tubular sheath body 1-1 and a suitable length. In a certain position axially of the tail stopper 5 and closer to the tail end side is formed a flange portion 35 for engagement with the rear-end opening portion (the expanded opening portion of the stopper mounting portion 8) of the tubular sheath portion 1-1. The portion from the flange portion 35 to the opening side serves as the tubular mounting portion 5-1 for the stopper mounting portion 8, while the tail end side serves as a cap holding portion 5-2.

The tubular mounting portion 5-1 has about the same length as the length of the stopper mounting portion 8 of the tubular sheath body 1-1 and its outer surface is formed in a tapered shape which tapers gradually (by degrees) from the flange portion 35 side toward the opening portion. In two front and rear positions, one on the opening portion side and the other on the flange portion 35 side, there are formed front and rear annular protuberances 29, 30 having diameters satisfying the relation of $L_8<L_9$. Further, between the annular protuberances 29 and 30 is formed a centering fit portion 33 which is also flat axially like the centering fit portion 34 of the stopper mounting portion 8 and which has an inside diameter $L_{10}$ larger than the diameter $L_8$ of the front-side annular protuberance 29 and smaller than the diameter $L_9$ of the rear-side annular protuberance 30 (see FIG. 11).

In order that the centering engagement of the centering fit portion 33 of the tubular mounting portion 5-1 with the centering fit portion 34 of the stopper mounting portion 8 may start before the simultaneous start of engagement of the front-side annular protuberances 29 and 31 with each other and of the rear-side annular protuberances 30 and 32 with each other, at the time of mounting of the tail stopper 5, their positional relations are duly set and thereafter formed on the tubular mounting portion 5-1 and the stopper mounting portion 8.

The construction of the front and rear annular protuberances 29, 30 and the centering fir portion 33 of the tubular mounting portion 5-1 can be understood from the above constructional explanation (correlation) of the front and rear annular protuberances 31, 32 and the centering fit portion 34 of the stopper mounting portion 8 of the tubular sheath body 1-1, and therefore a concrete explanation of their construction is here omitted.

Figure 14:
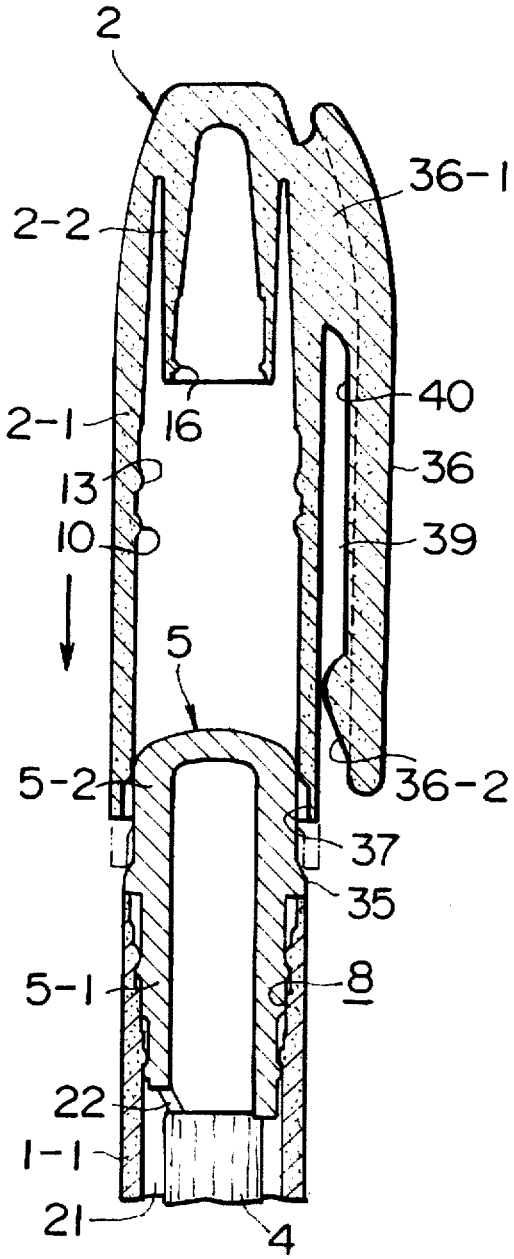
FIG. 14 is a longitudinal sectional view of the cap being fitted onto a cap holding portion of the tail stopper.

The cap holding portion 5-2 is formed on the tail end side of the tail stopper 5 at an outside diameter almost equal to the body 2-1, and t of the cap body 2-1, and the outer peripheral edge of its tail end is formed in an arch shape so that the longitudinal ribs 12 formed on the inner surface of the cap body can be fitted on the cap holding portion 5-2 smoothly in linear contact without being caught thereon (see FIG. 14).

The stopper mounting portion 8 of the tubular sheath portion 1-1 and the tubular mounting portion 5-1 of the tail stopper 5 are formed as above, so in the initial mounting stage of the tail stopper 5 the tapered tubular mounting portion 5-1 can be inserted in a rough condition from the largely expanded opening of the stopper mounting portion 8 into the portion 8. Besides, at this mounting stage, the front-side annular protuberance 29 of the tubular mounting portion 5-1 is inserted smoothly up to the front-side annular protuberance 31 of the stopper mounting portion 8 without coming into engagement with the rear-side annular protuberance 32 of the stopper mounting portion 8 and is engaged with the protuberance 31. Further, at the same time when the front-side annular protuberances 29 and 31 starts to engage each other, the rear-side annular protuberance 30 of the tubular mounting portion 5-1 is brought into engagement with the rear-side annular protuberance 32 of the stopper mounting portion 8. The engagement of the front-side annular protuberances 29 and 31 and that of the rear-side annular protuberances 30 and 32 are effected smoothly and positively because both engagements start after centering of the tail stopper 5 with respect to the tubular sheath body 1-1 which centering is performed by engagement of the centering fit portions 33 and 34.

Further, while the writing tool is in use, the cap 2 after removal from the cap mounting portion 7 can be fitted on the cap holding portion 5-2 of the tail stopper 5 (in a pushed-in state up to the dash-double dot line position in FIG. 14). Thus, not only during storage of the writing tool after use but also during use thereof (during writing) the cap 2 can be kept fitted on the tubular sheath 1 and hence it is no longer likely that the cap 2 will become missing.

Figure 15:
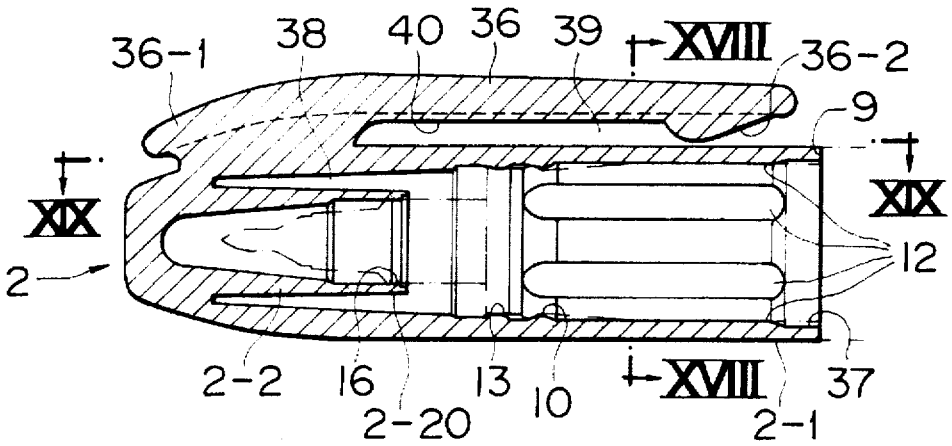
FIG. 15 is a longitudinal sectional view of the cap.

The cap 2 is formed to have a double tube structure comprising the cap body 2-1 and the inner cap 2-2 having the sealing fit portion 16 for sealing fit on the tip holding tubular portion 1-2, the cap body 2-1 having the override fit portion 10 and the sealing fit portion 13 both formed on its inner surface, the override fit portion 10 overriding and engaging the override fit portion 11 formed on the outer surface of the cap mounting portion 7, and the sealing fit portion 13 being fitted for sealing on the tubular front-end release portion 7-3, both at the time of mounting the cap 2 to the cap mounting portion 7 of the tubular sheath body 1-1 (see FIG. 15).

The cap body 2-1 is formed in the shape of a bottomed tube having an inside diameter almost equal to the outside diameter of the straight tubular portion 7-1 of the cap mounting portion 7 and also having a length capable of enclosing the whole of the cap mounting portion 7 including the writing tip 3 and the tip holding tubular portion 1-2 both projecting from the opening of the cap mounting portion 7. On the inner surface of the cap body 2-1 are provided axial, longitudinal ribs 12 and circumferential override fit portion 10 and sealing fit portion 13, while on the outer surface thereof is integrally provided a clip 36.

At the time of mounting of the cap 2, the longitudinal ribs 12 are brought into linear contact with the straight tubular portion 7-1 of the cap mounting portion 7 to not only diminish the contact resistance (sliding contact resistance) of the cap body 2-1 to the cap mounting portion 7 but also effect centering of the cap body with respect to the cap mounting portion 7. In the range from a certain inward position from the opening portion of the cap body 2-1 to an approximately intermediate position toward the inner bottom side from which the inner cap 2-2 projects coaxially, the longitudinal ribs 12 are formed at suitable intervals in the circumferential direction, and a loose-fit opening 37 having a diameter larger than the outside diameter of the straight tubular portion 7-1 of the cap mounting portion 7 is formed between the end portions of the ribs positioned on the opening side of the cap body 2-1 and the said opening.

The end portions of the longitudinal ribs 12 positioned on the opening side of the cap body 2-1 are formed in an arch shape (see the enlarged view in FIG. 1) so that, at the time of mounting of the cap 2, the longitudinal ribs 12 are fitted on and come into linear contact with the straight tubular portion 7-1 of the cap mounting portion 7 smoothly while being guided by the arched end portions indicated at 12-1.

The override fit portion 10 formed on the inner surface of the cap body gets over and engages the override fit portion 11 formed on the outer surface of the cap mounting portion 7, thereby holding the cap body 2-1 to prevent its accidental dislodgement from the cap mounting portion 7. The override fit portion 10 has an annular diameter which permits it to override and engage the override fit portion 11 and is formed in a predetermined position on the inner surface of the cap body 2-1. The override fit portion 10 is formed on the inner surface of the cap body 2-1 after setting a positional relation thereof to the outer-surface override fit portion 11 in such a manner that its override engagement with the override fit portion 11 is started just before, or thereabouts, the cap body 2-1 is pushed in for the cap mounting portion 7 up to its mounting limit corresponding to collision of the opening portion of the cap body 2-1 with the cap mounting base end 9. In the figure (see FIG. 15) the override fir portion 10 is formed on the inner surface of the cap body 2-1 so that the end portions of the longitudinal ribs 12 positioned on the inner bottom side are arranged side by side in the circumferential direction.

The sealing fit portion 13, at the time of mounting of the cap 2, is fitted on the tubular front-end release portion 7-3 of the cap mounting portion 7 so as to seal the air changing ports 15 through the gap 14 which is ensured between the tip holding tubular portion 1-2 and the cap mounting portion 7, the air ports 15 being opened in the connecting portion 6 at the bottom of the gap 14. On the inner surface of the cap body 2-1 the sealing fit portion 13 is formed in the vicinity of the override fit portion 10 and on the inner bottom side of the cap body 2-1 so as to have an annular diameter almost equal to the outside diameter of the tubular front-end release portion 7-3. The sealing fit portion 13 is formed on the inner surface of the cap body 2-1 after setting a positional relation between it and the override fit portion 10 on the cap body inner surface in such a manner that the sealing engagement of the sealing fit portion 13 of the cap body 2-1 with the tubular front-end release portion 7-3 and the override engagement of the override fit portion 10 with the override fit portion 11 formed on the outer surface of the cap mounting portion 7 start simultaneously.

The inner cap 2-2 is fitted on the tip holding tubular portion 1-2 at the time of mounting of the cap 2 and functions to seal the writing tip 3 (prevent volatilization of ink). It is formed coaxially with the cap body 2-1 from the inner bottom side of the cap body and at an outside diameter smaller than the inside diameter of the cap body 2-1, with a sink preventing gap 38 being formed between the inner cap 2-2 and the cap body 2-1. The wall thickness of the inner cap 2-2 at least in its sealing fit range onto the tip holding tubular portion 1-2 is made smaller than that of the other portion thereof, and the sealing fit portion 16 is formed at this thin-walled portion which is indicated at 2-20.

The sealing fit portion 16 is formed on the inner surface of the thin-walled portion 2-20 at an annular diameter almost equal to the outside diameter of the tip holding tubular portion 1-2 and in the vicinity of the opening portion of the inner cap 2-2, and is fitted for sealing on the tip holding tubular portion 1-2 at the time of mounting of the cap 2. In this case, the sealing fit portion 16 is provided on the inner surface of the inner cap 2-2 after setting a positional relation thereof in such a manner that the sealing engagement of the fit portion 16 with the tip holding tubular portion 1-2 and the foregoing override and sealing engagements of the cap body 2-1 with the cap mounting portion 7 are started simultaneously.

The cap 2 is formed as above, so when the cap is mounted to the cap mounting portion 7 of the tubular sheath body 1-1, the longitudinal ribs 12 of the cap body 2-1 come into linear contact with the straight tubular portion 7-1 of the cap mounting portion 7, whereby the load of contact with the tubular sheath body 1-1 is diminished as compared with that in face contact. After centering of the cap body 2-1 with respect to the tubular sheath body 1-1 has been effected by such linear contact, the override and sealing engagements of the override and sealing fit portions 10, 13 formed on the inner surface of the cap body 2-1 with the override fit portion 11 formed on the outer surface of the cap mounting portion 7 and with the tubular front-end release portion 7-3, and the sealing engagement of the sealing fit portion 16 formed on the inner surface of the inner cap 2-2 with the tip holding tubular portion 1-2, start simultaneously and end also simultaneously (from the state of FIG.16 to the state of FIG. 17). Thus, the cap 2 can be mounted smoothly to the cap mounting portion 7. Besides, the loading on a fingertip is only once during that mounting operation, and thus the mounting of the cap 2 can be done with great ease, whereby the handleability of the writing tool is improved.

The clip 36 is contiguous to the cap body 2-1 on the head side of the cap body 2-1 through a connecting leg portion 36-1. At a width larger than the projecting width of the connecting leg portion 36-1 the clip 36 is formed integrally with the outer surface of the cap body 2-1 throughout the overall length toward the opening portion of the cap body 2-1, including the connecting leg portion 36-1, with an air flow gap 39 being formed between the clip 36 and the outer surface of the cap body 2-1. On the back of the clip 36 is formed a longitudinal reinforcing rib 40 extending at a width almost equal to the projecting width of the connecting leg portion 36-1 from a gripping protuberance 36-2 formed on the front end side to the connecting leg portion 36-1, the rib 40 being contiguous in a rounded shape to the base of the connecting leg portion 36-1, to not only reinforce the strength of connection with the connecting leg portion 36-1 but also improve the gripping force of the clip 36.

Further, on the outer surface of the cap body 2-1 thus provided with the clip 36 are formed two longitudinal grooves 41 on both sides of the connecting leg portion 36-1, the longitudinal grooves 41 extending continuously in parallel from the head portion of the cap body 2-1 toward the opening portion thereof. The two longitudinal grooves 41 function to ensure the flow of air in cooperation with the air flow gap 39 in the event an infant for example should swallow the cap. In the range from the base of the connecting leg portion 36-1 to the opening portion of the cap body 2-1 the two longitudinal grooves 41 are formed in parallel and suitably spaced in the circumferential direction in relation to the point just under the longitudinal reinforcing rib 40 formed on the back of the clip 36. Moreover, a rib abutting portion 42 is formed on the outer surface of the cap body 2-1 from the base of the connecting leg portion 36-1 positioned just under the longitudinal reinforcing rib 40 up to the opening portion of the cap body 2-1 so that when the clip 36 undergoes a strong force and is pushed toward the outer surface of the cap body 2-1, the resulting deformation (amount of deformation) is suppressed upon abutment of the rib 40 with the rib butting portion 42. That is, even when the clip 36 is deformed as if it were crushed toward the cap body 2-1, there is ensured the air flow gap 39 between the clip 36 and the outer surface of the cap body 2-1 which air flow gap 39 corresponds to the height of the longitudinal reinforcing rib 40.

Figure 20:
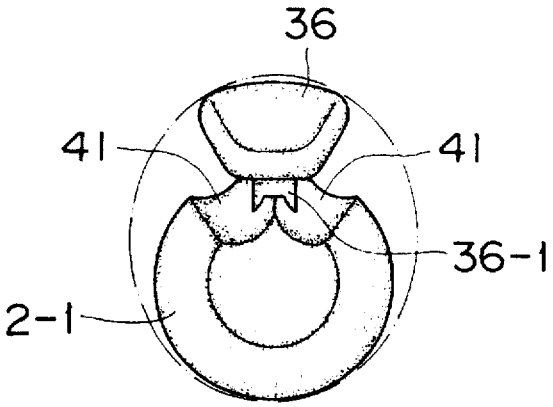
FIG. 20 is a side view thereof.

According to the above construction of the cap 2, even in the event an infant should swallow the cap and the cap should stay in the throat of the infant, the flow of air is ensured by the air flow gap 39 formed between the outer surface of the cap body 2-1 and the clip 36. Additionally, a wider and fully sufficient air flow area is ensured safely by the two longitudinal grooves 41 extending continuously in parallel from the head portion of the cap body 2-1 toward the opening portion of the cap body (see FIG. 20).

Further, even if the clip 36 experiences a strong force and is pushed toward the cap body 2-1, thus causing deformation thereof, this deformed state is suppressed upon abutment of the longitudinal reinforcing rib 40 formed on the back of the clip with the rib abutting portion 42. Besides, even if the air flow area of the air flow gap 39 formed between the clip 36 and the cap body 2-1 is decreased by that deformation, there is ensured a minimum air flow area (air flow path) between the clip 36 and the two longitudinal grooves 41. Thus, the safety required for the writing tool is ensured.

The gripping force of the clip 36 for a notebook or a clothing pocket P during non-use of the writing tool is ensured by the longitudinal reinforcing rib 40 formed on the back of the clip 36. Besides, there is obtained a connection strength with the connecting leg portion 36-1 because the longitudinal reinforcing rib 40 is contiguous in a rounded shape to the connecting leg portion 36-1. Consequently, a further improvement of the connection strength of the clip 36 relative to the cap body 2-1 can be expected.

Moreover, when a notebook or a clothing pocket P is gripped by the clip 36, the two longitudinal grooves 41 extending from the head portion of the cap body 2-1 to the opening portion thereof cushions the state of contact of the clip 36 with the notebook or the pocket P from under the notebook or pocket. According to the gripping structure being considered, the clip 36 grips the notebook or pocket P conjointly with the rib abutting portion 42 which is present just under the clip and between the two longitudinal grooves 41, so that the clip 36 can be attached to or detached from the notebook or pocket P smoothly (see FIG. 18).

Figure 21A:
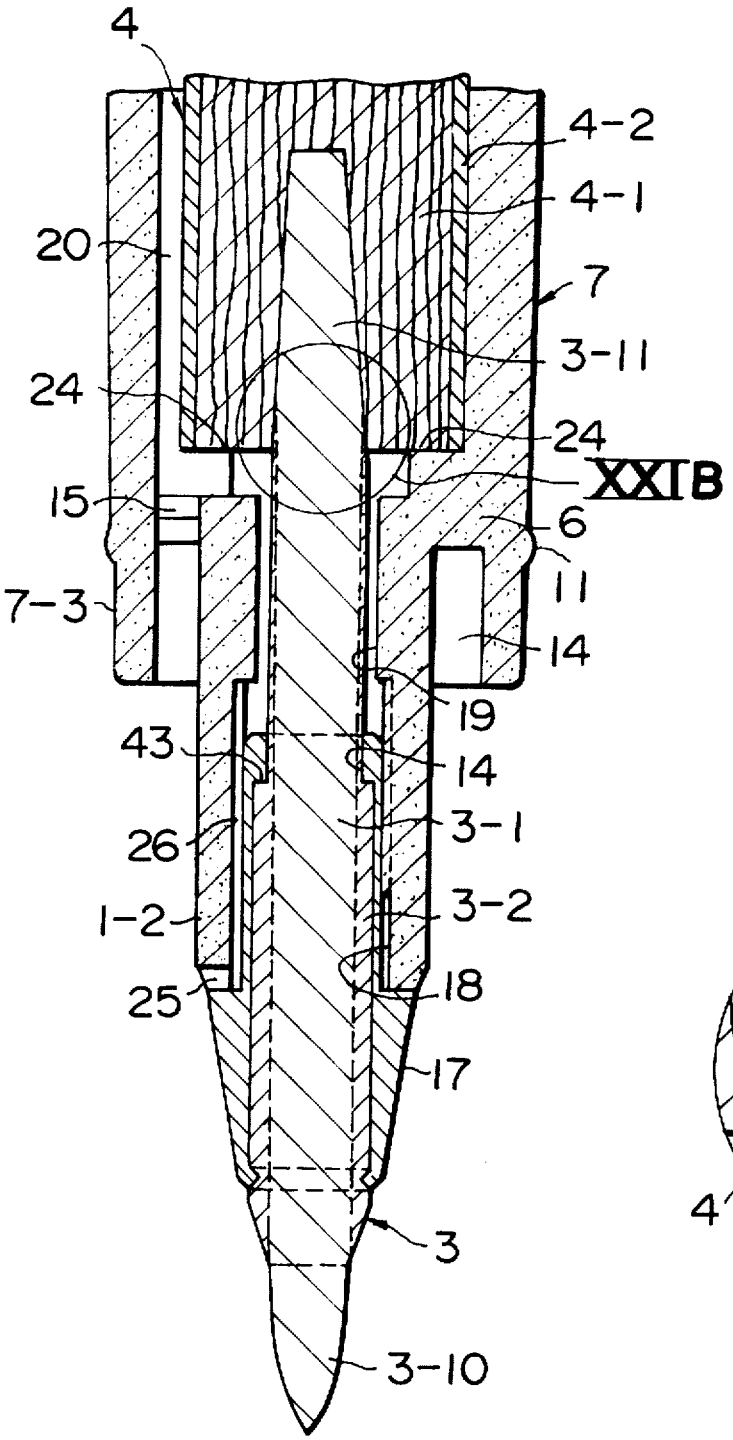
FIG. 21A is an enlarged longitudinal sectional view of principal portions, showing the front side of the tubular sheath with a writing tip held therein.
Figure 21B:
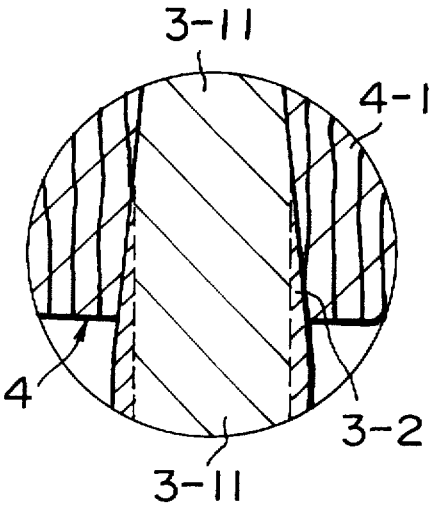
FIG. 21B is an enlarged section view taken at XXIB of FIG. 21A.

Further, in the present invention, as shown in FIG. 21, the whole of the writing tip 3, except its front portion 3-10 serving as the writing part of the ink leading core portion 3-1 which is made of a soft synthetic resin material and also except its rear portion 3-11 inserted communicationwise into the interior of the ink absorbing and storage member 4, is covered integrally with a tubular housing portion 3-2 formed of a rigid synthetic resin material. The writing tip 3 has a stepped rod-like shape whose front portion 3-10 side, with an approximately intermediate position in the longitudinal direction as a boundary, is thick and whose rear portion 3-11 side is tapered toward the rear end at a thickness permitting the formation of the air flow gap 27 between it and the inner surface of the small-diameter portion 19 of the tip holding tubular portion 1-2 and so as to be inserted into the ink absorbing and storage member 4 in the tubular sheath body 1-1.

As shown in the figure, the rear portion 3-11 side of the ink leading core portion 3-1 is covered with the tubular housing portion 3-2 in such a manner that, when the rear portion 3-11 is inserted into the interior of the ink absorbing and storage member 4, part of the tubular housing portion 3-2 is also inserted into the ink absorbing and storage member 4 together with the rear portion 3-11, to prevent the ink leading core portion 3-1 from being exposed in the inserted state of the rear portion 3-11 into the ink absorbing and storage member 4 (see the enlarged view). Thus, an improvement is made to avoid the influence of air pressure at the time of mounting of the cap 2 such that the air fed into the tubular sheath body 1-1 at the time of mounting of the cap 2 gets into the ink leading core portion 3-1 and the ink in the same core portion is pushed out to the front portion 3-10 side.

According to the writing tip 3 constructed as above, appropriate flexibility and restoring force required as a writing-brush pen are exhibited by both the writing part of the ink leading core portion 3-1 formed of a soft synthetic resin material and the tubular housing portion 3-2 formed of a rigid synthetic resin material and extending up to near the said writing part. Besides, the leading of ink from the ink absorbing and storage member 4 is ensured by the ink leading core portion 3-1 which is inserted communicationwise into the interior of the ink absorbing and storage member 4. Moreover, it is possible to prevent the occurrence of a dripping phenomenon such that the ink in the ink absorbing and storage member 4 is pushed toward the front portion 3-10 and is discharged from the writing part of the front portion or is discharged in a larger amount than necessary from the said writing part during use of the writing tool, due to the pressure of air which has been fed into the tubular sheath body 1-1 and got into the ink leading core portion 3-1 from the rear portion 3-10 side.

Further, the ferrule 17 formed of a metal for mounting and holding the writing tip 3 with respect to the tip holding tubular portion 1-2 is formed to have a length capable of covering the writing tip 3 from its stepped portion 43 up to its front portion 3-10 side exclusive of the writing part, and at its rear-end opening portion is formed a retaining portion 44 to abut and retain the stepped portion 43, while its front-end opening portion is retained by caulking to the writing tip 3, whereby the writing tip 3 can be mounted firmly in a stationary state relative to the ferrule 17.

Thus, there is no fear of the writing tip 3 from coming off or sinking into the ferrule 17 during use of the writing tool, and hence there is attained an improvement of the functional characteristics which promises the writing stability.

EFFECTS OF THE INVENTION

Since the writing tool of the present invention is constructed as above, it exhibits the following effects.

According to claim 1, the override fit motion and the sealing fit motion start simultaneously at the time of mounting of the cap and the cap is thereby fitted on the tubular sheath. Thus, since the sealing fit on the tubular sheath for the purpose of sealing and the override fit on the tubular sheath for the preventing of dislodgement of the cap are done at the same time both in the mounted state of the cap, the loading on a finger tip is only once in the course of mounting of the cap and hence it is possible to improve the handleability of the writing tool.

Further, at the time of mounting of the cap, the air present inside the inner cap flows from the exhaust ports of the tip holding tubular portion, then through the inner, longitudinal air flow grooves and air flow gap, and is discharged into the tubular sheath body, so that a more internal pressure than necessary is not developed inside the inner cap at the time of mounting of the cap. Also at the time of removal of the cap, since communication from the exhaust ports to the interior of the tubular sheath body is ensured through the longitudinal air flow grooves and the air flow gap, there does not occur a pressure reducing action (attraction) inside the inner cap in the course of removal of the inner cap from the tip holding tubular portion. In other words, at the time of mounting and removal of the cap it is possible to prevent the occurrence of a reverse flow phenomenon such that the ink in the writing tip is pushed back to the ink absorbing and storage member side at the time of mounting or removal of the cap and the shortage of ink results when the writing tool is used. It is also possible to prevent a larger amount of ink than necessary from being drawn in from the ink absorbing and storage member to the writing tip and being discharged to the exterior at the time of mounting or removal of the cap or prevent a dripping phenomenon which is the discharge of ink from the writing tip in a larger amount than necessary at the time when the writing tool is in use. Consequently, it is possible to attain an improvement of functional characteristics which promises the stability of writing. Further, the ferrule holds the writing tip in an exactly centered state with respect to the tip holding tubular portion which is done by linear contact with the longitudinal holding ribs, whereby the stabilization of quality in assembly can be attained.

Further, at the time of mounting of the cap, the air present within the cap body is fed from the air ports for the change of air to the front end of the ink absorbing and storage member in the tubular sheath body, then passes through the longitudinal air flow grooves each formed between adjacent longitudinal holding ribs and further through the air flow gap formed between the ink absorbing and storage member and the tubular sheath body and is fed to the tail stopper side, then gets into the interior of the tail stopper through the air intake port of the tail stopper and is fed to the rear end of the ink absorbing and storage member. Thus, it is possible to prevent the shortage of ink and the dripping phenomenon which are caused by the feed of air to only one of the front and rear ends of the ink absorbing and storage member and the resulting increase in internal pressure on only the one side. As the aforementioned, it is possible to attain an improvement of functional characteristics which promises the writing stability. Moreover, since the ink absorbing and storage member is held firmly in a centered state within the tubular sheath body by both the longitudinal holding ribs formed on the inner surface of the tubular sheath body and the tail stopper, the stability of quality in assembly is attained.

According to claim 2, the flow of air is ensured by the air flow gap formed between the outer surface of the cap and the clip. Besides, a wide and fully sufficient air flow area is ensured safely by the two longitudinal grooves extending continuously in parallel from the head portion of the cap toward the opening portion thereof, in cooperation with the said air flow gap. Therefore, even if an infant should swallow the cap and the cap should stay in the throat of the infant, the flow of air is ensured, that is, safety is ensured.

According to claims 3 or 4, the elastic effect of the inner cap is promoted by its thin-walled portion and at the same time the friction of the inner cap against the tip holding tubular portion is diminished by such elastic effect, so even if the sealing fit motion of the inner cap is done repeatedly for the tip holding tubular portion, the fitting force (sealing force) of the inner cap for the tip holding tubular portion is kept constant over a long period by both excellent elastic effect of the inner cap and reduced friction of the inner cap against the tip holding tubular portion. That is, since the sealing effect of the inner cap on the writing tip is maintained constant over a long period, the volatilization of ink is prevented to a perfect extent and hence the stabilization of quality is promised over a long period.

According to claim 5, appropriate flexibility and restoring force required as a writing-brush pen are exhibited by both the writing part of the ink leading core portion formed of a soft synthetic resin material and the tubular housing portion formed of a rigid synthetic resin material. Besides, since the leading of ink from the ink absorbing and storage member is done surely by the ink leading core portion which is communicated with the interior of the ink absorbing and storage member, the writing clip appropriate for a writing-brush pen can be available.

Further, with the rear portion of the ink leading core portion inserted into the ink absorbing and storage member, part of the tubular housing portion which covers the said rear portion is also inserted into the ink absorbing and storage member and therefore the ink leading core portion is not exposed in a bare state. Thus, it is possible to prevent ink from being discharged from the front writing part which is caused by entry of air into the ink leading core portion from the rear side which air has been fed into the tubular sheath body and by forcible shift of ink from the ink leading core portion to the front side under the resulting air pressure, or prevent the dripping phenomenon of ink being discharged in a larger amount than needed from the writing part. In this way there is made an improvement of the functional characteristics which promises the writing stability.

According to claims 6 or 7, since fine metallic grains embedded in a synthetic resin material are brilliant in an innumerably dotted state in the surfaces of the tubular sheath and the cap, there are attained an appearance beauty and an ornamental effect of strong impact to the consumers' eyes.

Thus, the writing tool according to the present invention is an epoch-making writing tool satisfying all of the conditions required for the writing tool which are, for example, superior functional characteristics such as there being no fear of ink shortage during use of the writing tool or of dripping phenomenon that is the discharge of a larger amount of ink than needed, and excellent feeling of writing, superior handle ability such as easy mounting and removal of the cap, high safety such as the flow of air being ensured to prevent suffocation even in the event of swallowing the cap, and excellent ornamental characteristics based on appearance beauty.

Further, both improvement of productivity and reduction of the manufacturing cost can be attained because it is possible to expect improvement of the assembling performance such as easy execution of centering and improvement of the cap mounting and removing performance.

Having described specific preferred embodiments of the invention with reference to the accompanying drawings, it will be appreciated that the present invention is not limited to those precise embodiments, and that various changes and modification can be effected therein by one of ordinary skill in the art without departing from the scope or spirit of the invention as defined by the appended claims.

What is claimed is:

1. A writing tool wherein a writing tip supplied with ink from an ink absorbing and storage member loaded into a tubular sheath is attached to a front end of the tubular sheath through a ferrule, a cap for sealing the writing tip is attached to said front end detachably, and a tail stopper is attached to a rear end of the tubular sheath, the tool comprising:

the cap having a double tube structure comprising a bottomed tubular cap body and an inner cap provided coaxially within the cap body, and the tubular sheath comprising a tubular sheath body into which is loaded the ink absorbing and storage member and a tip holding tubular portion which is contiguous to the tubular body coaxially through a connecting portion and to which the writing tip is attached, the cap body, at the time of mounting of the cap, being fitted on a cap mounting portion of the tubular sheath body and the inner cap being fitted on the tip holding tubular portion;

override fit portions and sealing fit portions being provided between said cap and said tubular sheath, said override fit portion and said sealing fit portion starting the respective override fit motion and sealing fit motion simultaneously at the time of mounting of the cap;

exhaust ports being formed in an opening portion of the tip holding tubular portion, several longitudinal holding ribs for holding the ferrule being formed on the inner surface of the tip holding tubular portion, and an air flow gap extending from said exhaust ports into the tubular sheath body through the longitudinal air flow grooves each formed between adjacent said longitudinal holding ribs being formed; and air ports communicating with the interior of the tubular sheath body being formed in the connecting portion between the tip holding tubular portion and the tubular sheath body, several longitudinal holding ribs for holding the front side of the ink absorbing and storage member being formed on the front-side inner surface of the tubular sheath body and an air flow gap extending from said air ports through longitudinal air flow grooves each formed between adjacent said the longitudinal holding ribs up to the tail stopper side which abuts and holds the rear side of the ink absorbing and storage member, an air intake port being formed in the tail stopper and which provides communication between said air flow gap and the interior of the tail stopper.

2. A writing tool according to claim 1, wherein said cap is integrally provided with a clip which is wider than a projecting width of a connecting leg portion and which forms an air flow gap extending from a head portion including said connecting leg portion up to an opening portion, and the cap being also provided with parallel, continuous, longitudinal grooves extending from the head portion up to the opening portion on both sides of the connecting leg portion.

3. A writing tool according to claim 2, wherein the wall thickness of the inner cap at least in the fitted range thereof onto the tip holding tubular portion is smaller than that of the other portion, and a sealing fit portion is formed on this thin-walled portion.

4. A writing tool according to claim 2, wherein the tubular sheath and the cap are formed by molding using a synthetic resin material with fine metallic grains embedded therein.

5. A writing tool according to claim 1, wherein the wall thickness of the inner cap at least in the fitted range thereof onto the tip holding tubular portion is smaller than that of the other portion, and a sealing fit portion is formed on this thin-walled portion.

6. A writing tool according to claim 1, wherein the writing tip is for a writing-brush pen and comprises an ink leading core portion made of a soft synthetic resin material and a tubular housing portion made of a rigid synthetic resin material, the whole of the ink leading core portion except for the front and rear portions thereof being integrally covered with the tubular housing portion; and the tubular housing portion covers the rear side of the ink leading core portion in such a manner that a portion thereof is inserted together with said rear side into the ink absorbing and storage member.

7. A writing tool according to claim 1, wherein the tubular sheath and the cap are formed by molding using a synthetic resin material with fine metallic grains embedded therein.

* * * * *